US010573481B1

(12) United States Patent
Katsap

(10) Patent No.: US 10,573,481 B1
(45) Date of Patent: Feb. 25, 2020

(54) ELECTRON GUNS FOR ELECTRON BEAM TOOLS

(71) Applicants: NuFlare Technology, Inc., Kanagawa (JP); NuFlare Technology America, Inc., Sunnyvale, CA (US)

(72) Inventor: Victor Katsap, Cornwall, NY (US)

(73) Assignees: NuFlare Technology, Inc., Kanagawa (JP); NuFlare Technology America, Inc., Sunnyvale, CA (US)

( * ) Notice: Subject to any disclaimer, the term of this patent is extended or adjusted under 35 U.S.C. 154(b) by 0 days.

(21) Appl. No.: 16/203,510

(22) Filed: Nov. 28, 2018

(51) Int. Cl.

| | |
|---|---|
| ***H01J 1/46*** | (2006.01) |
| ***H01J 3/02*** | (2006.01) |
| ***H01J 1/148*** | (2006.01) |
| ***H01J 9/18*** | (2006.01) |

(52) U.S. Cl.
CPC ..... *H01J 1/46* (2013.01); *H01J 1/148* (2013.01); *H01J 3/024* (2013.01); *H01J 3/027* (2013.01); *H01J 9/18* (2013.01); *H01J 2209/18* (2013.01)

(58) Field of Classification Search
None
See application file for complete search history.

(56) References Cited

U.S. PATENT DOCUMENTS

| | | | | |
|---|---|---|---|---|
| 4,430,570 | A * | 2/1984 | Takigawa | H01J 1/148 250/396 R |
| 5,854,490 | A * | 12/1998 | Ooaeh | H01J 37/065 250/492.23 |
| 6,333,508 | B1 * | 12/2001 | Katsap | B82Y 40/00 250/423 R |
| 7,176,610 | B2 | 2/2007 | Katsap | |
| 9,165,737 | B2 | 10/2015 | Katsap | |
| 2003/0010934 | A1 * | 1/2003 | Katsap | H01J 37/065 250/492.1 |
| 2006/0289781 | A1 * | 12/2006 | Tanimoto | B82Y 10/00 250/396 R |
| 2014/0117839 | A1 * | 5/2014 | Saito | H01J 1/13 313/421 |
| 2016/0064174 | A1 * | 3/2016 | Miyamoto | H01J 37/065 315/30 |
| 2018/0169784 | A1 * | 6/2018 | Ekberg | B22F 3/1055 |

* cited by examiner

*Primary Examiner* — Ashok Patel
(74) *Attorney, Agent, or Firm* — Oblon, McClelland, Maier & Neustadt, L.L.P.

(57) ABSTRACT

An electron emission apparatus, an electron gun, and a method of fabrication of the electron gun are provided. The electron gun includes a cathode, a Wehnelt, and an anode. The cathode is configured to provide an electron beam. The Wehnelt has a bore. The bore is configured to pass the electron beam. The anode is disposed proximate to the cathode. The diameter of the bore of the Wehnelt and the offset between the Wehnelt and the cathode satisfy a predetermined dimensional relationship. The predetermined dimensional relationship is at least a function of a diameter of the bore of the anode and a distance between the Wehnelt and the anode.

15 Claims, 6 Drawing Sheets

ELECTRON GUNS FOR ELECTRON BEAM TOOLS

BACKGROUND

1. Field

This invention generally relates to electron guns. In particular, the invention provides electron guns having a stable crossover size and position, thereby prolonging the useful life of cathodes of the electron guns.

2. Background

Existing electron-beam (e-beam) lithography tools (e.g., lithographic tools, probes, free electron lasers, and electron and ion guns) and characterization tools (e.g., scanning electron microscopes (SEMs) and transmission electron microscopes (TEMs)) use cathodes primarily made of lanthanum hexaboride ($LaB_6$), cerium hexaboride ($CeB_6$), in sintered or crystalline form. Unlike conventional Ba-based and Schottky-type cathodes, in $LaB_6$ cathodes, the emitting $LaB_6$ crystal size diminishes during operation. As a result, the cathode emitting area sinks into surrounding non-emissive material. These phenomena are referred to as $LaB_6$ crystal loss. Crystal loss causes gun crossover displacement, or drift, toward an anode of an electron gun. Further, the crossover size increases with crystal loss. The crossover displacement and the size increase cause a larger final electron spot size and a larger beam blur in e-beam systems such as SEMs, X-ray sources, and e-beam lithography machines. At typical operating temperatures (1650K to 1900K (Kelvin)), $LaB_6$ crystalline material evaporates at the rate of several microns per 100 hours, which limits the cathode's useful life.

Cathodes of electron guns have a short lifetime due to the effect of crystal loss on the crossover of the electron guns. Accordingly, what is needed, as recognized by the present inventor, is an electron gun having a lower sensibility to the crystal loss of the cathode.

The foregoing "Background" description is for the purpose of generally presenting the context of the disclosure. Work of the inventor, to the extent it is described in this background section, as well as aspects of the description which may not otherwise qualify as prior art at the time of filing, are neither expressly or impliedly admitted as prior art against the present invention.

SUMMARY

The present disclosure relates to an electron gun. The electron gun includes a cathode, a Wehnelt, and an anode. The cathode is configured to provide an electron beam. The Wehnelt has a bore. The bore is configured to pass the electron beam. The anode is disposed proximate to the cathode. The diameter of the bore of the Wehnelt and the offset between the Wehnelt and the cathode satisfy a predetermined dimensional relationship. The predetermined dimensional relationship is at least a function of a diameter of the bore of the anode and a distance between the Wehnelt and the anode.

The present disclosure also relates an electron emission apparatus. The electron emission apparatus includes an electron gun. The electron gun includes a cathode, a Wehnelt, and an anode. The cathode is configured to provide an electron beam. The Wehnelt has a bore. The bore is configured to pass the electron beam. The anode is disposed proximate to the cathode. The diameter of the bore of the Wehnelt and the offset between the Wehnelt and the cathode satisfy a predetermined dimensional relationship. The predetermined dimensional relationship is at least a function of a diameter of the bore of the anode and a distance between the Wehnelt and the anode.

The present disclosure also relates to a method of manufacturing an electron gun. The method includes providing a cathode configured to provide an electron beam, providing a Wehnelt having a bore configured to pass the electron beam, depositing the Wehnelt proximate to the cathode, and depositing an anode proximate to the cathode. A diameter of the bore of the Wehnelt and an offset between the Wehnelt and the cathode satisfy a predetermined dimensional relationship. The predetermined dimensional relationship is at least a function of a diameter of the bore of the anode and a distance between the Wehnelt and the anode.

In one aspect, the diameter of the bore of the Wehnelt is in a range from 1.4 mm to 2.5 mm.

In one aspect, the offset between the Wehnelt and the cathode is in a range from 0.4 mm to 0.8 mm.

In one aspect, a thickness of an aperture of the Wehnelt is in a range of 0.15 mm to 0.30 mm.

In one aspect, the predetermined dimensional relationship is:

$$(D-A\times\Delta)^2/S^{\acute{\alpha}}>B\times(G_a+d_a/\sigma)$$

where D is the diameter of the bore of the Wehnelt, S is the offset between the Wehnelt and the cathode, A is a first predetermined coefficient in a range from 0.6 to 1.2, Δ is a thickness of an aperture of the Wehnelt, B is a second predetermined coefficient in a range from 0.028 to 0.068, $G_a$ is the distance between the Wehnelt and the anode; $d_a$ is the diameter of the bore of the anode, σ is a third coefficient in a range from 11.5 to 12.5, and $\acute{\alpha}$ is a fourth coefficient in a range from 1.05 to 1.115.

The foregoing paragraphs have been provided by way of general introduction, and are not intended to limit the scope of the claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
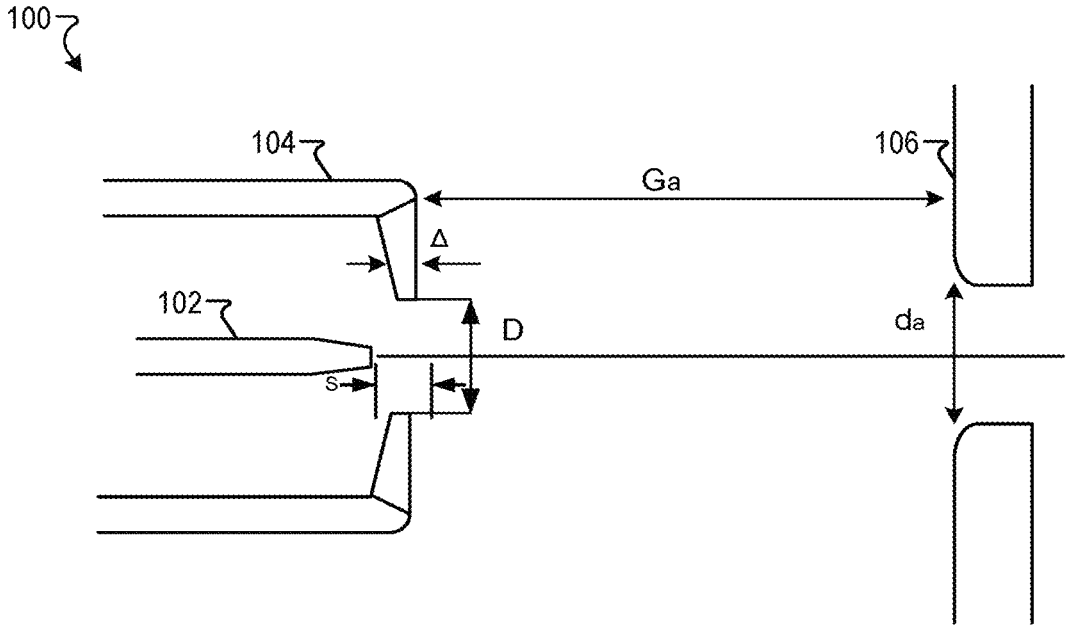
FIG. 1 is a schematic of an electron gun according to one example.

Referring now to the drawings, wherein like reference numerals designate identical or corresponding parts throughout several views, the following description relates to an electron gun, an apparatus, and associated methodology for electron-beam (e-beam) lithography. The electron gun including a high brightness $LaB_6$ cathode described herein has a stable crossover size and axial location.

FIG. 1 is a schematic of an electron gun 100 according to one example. The electron gun 100 includes a cathode 102, a Wehnelt 104, and an anode 106. The cathode 102 may be a lanthanum hexaboride ($LaB_6$) crystal. The Wehnelt 104 is arranged between the cathode 102 and the anode 106 along an emission axis. The anode 106 is grounded. The electron gun 100 is connected to a power source. The electron gun 100 has a Wehnelt-cathode offset S, a Wehnelt aperture thickness Δ, a Wehnelt bore diameter D, a Wehnelt-anode distance $G_a$, and an anode bore diameter $d_a$. The Wehnelt aperture thickness Δ is in the range from about 0.15 mm to about 0.30 mm.

Figure 2A:
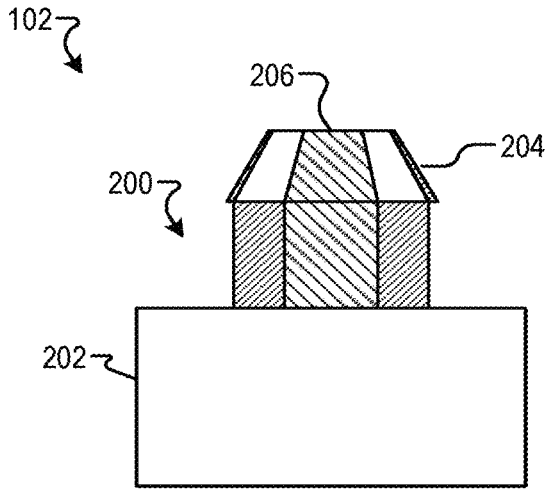
FIG. 2A is a schematic that shows a cross-sectional side view of a cathode according to one example.

FIG. 2A is a schematic that shows a cross-sectional side view of the cathode 102 according to one example. The cathode 102 includes an emitter 200. The cathode 102 is held in a holder 202 (i.e., support, base, emitter holder). The holder 202 holds the emitter 200 steady in space. The cathode 102 may be that disclosed, for example, in U.S. Pat. No. 9,165,737 entitled "HIGH BRIGHTNESS, LONG LIFE THERMIONIC CATHODE AND METHOD OF ITS FABRICATION," the entire disclosure of which is incorporated herein by reference.

In one example, an upper part of the emitter 200 has a conical surface 204 and an electron emitting surface 206 provided at an upper end of the upper part. The cathode emitter cone angle may be in the range from about 20 degrees to about 90 degrees, e.g., about 20, 25, 30, 35, 40, 45, 50, 55, 60, 65, 70, 75, 80, 85, or 90 degrees.

In one implementation, sidewalls of the emitter 200 may be coated with a non-emissive material for higher practical brightness. The coating may be formed from any suitable material, examples of which include but are not limited to graphite, colloidal graphite (e.g., aquadag), DLC (diamond-like carbon), pyrolytic carbon, and the like. The choice of carbon coating may depend upon several factors, including but not limited to cost of cathode production, facilities available for carrying out the deposition, and the like.

Figure 2B:
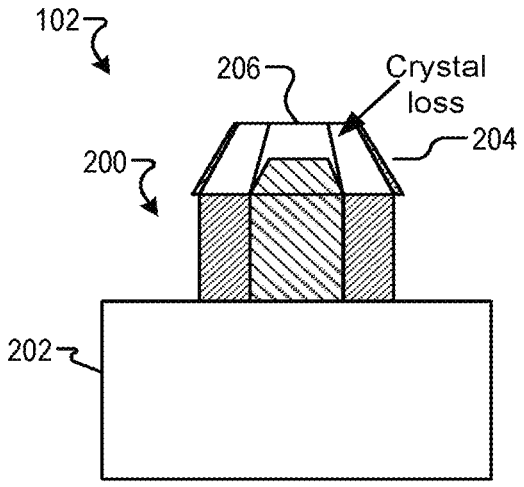
FIG. 2B is a schematic that shows a cross-sectional side view of a worn-out cathode according to one example.

FIG. 2B is a schematic that shows the cross-sectional side view of a worn-out cathode 102 according to one example. At operating temperature, $LaB_6$ evaporates with a rate that depends on temperature and vacuum pressure, usually about 4 microns/100 hours. The evaporation does not change the shape of the main body significantly because the crystal body size is about 200 μm to 800 μm. However, the tip, which has a smaller diameter (e.g., 50 μm), is more affected by the loss, which adversely affects cathode optics and emission as described previously herein.

Figure 3A:
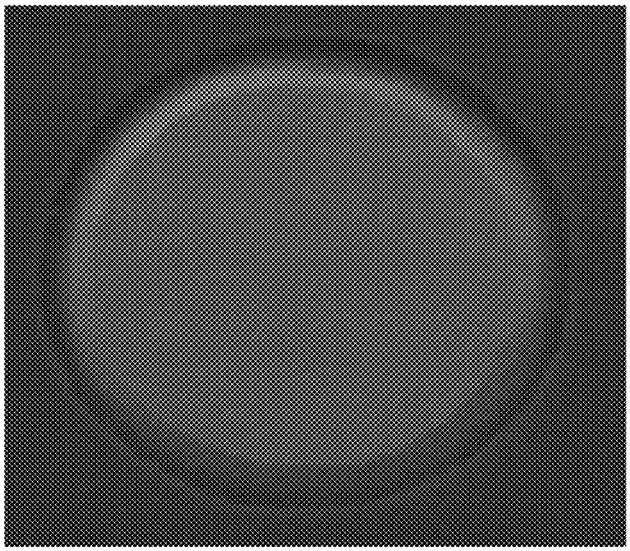
FIG. 3A is a schematic that shows an scanning electron microscope (SEM) image of the cathode according to one example.
Figure 3B:
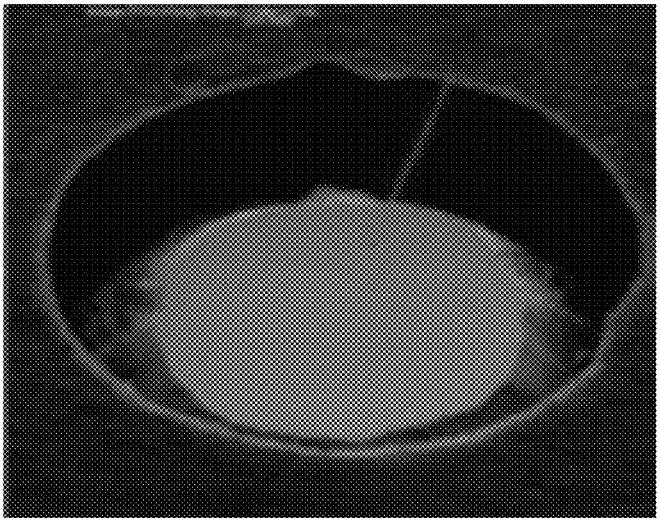
FIG. 3B is a schematic that shows the SEM image of the worn-out cathode according to one example.

FIG. 3A shows an SEM image of a new cathode (at zero operating hours) of FIG. 2A. FIG. 3B shows the damage to the cathode after several hundred hours of operation. As can be seen, the edges of the emitting surface of the cone appear to be partially damaged (e.g., pitted and/or etched). These areas of the emitting surface are compromised and are no longer capable of efficiently emitting electrons in a focused manner as described later herein.

Figure 4A:
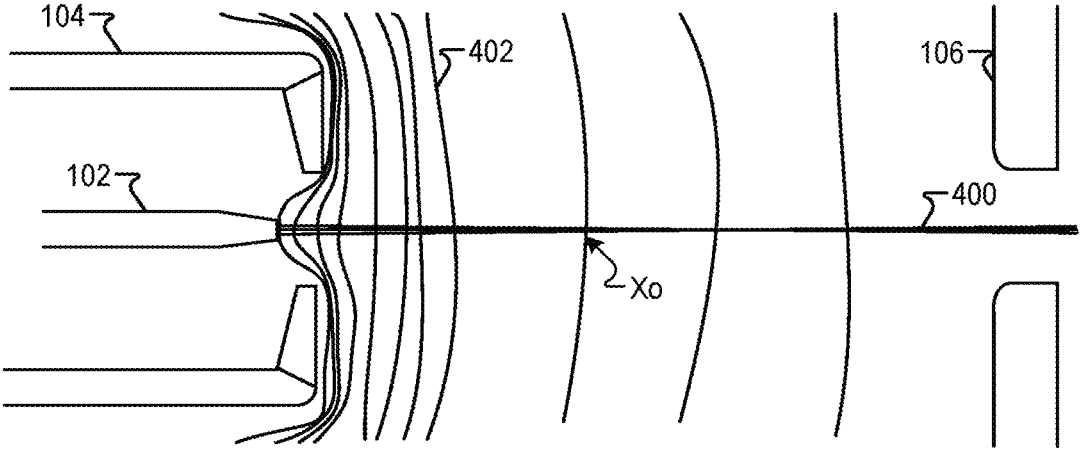
FIG. 4A is a schematic that shows an electric field and an electron beam of the electron gun according to one example.
Figure 4B:
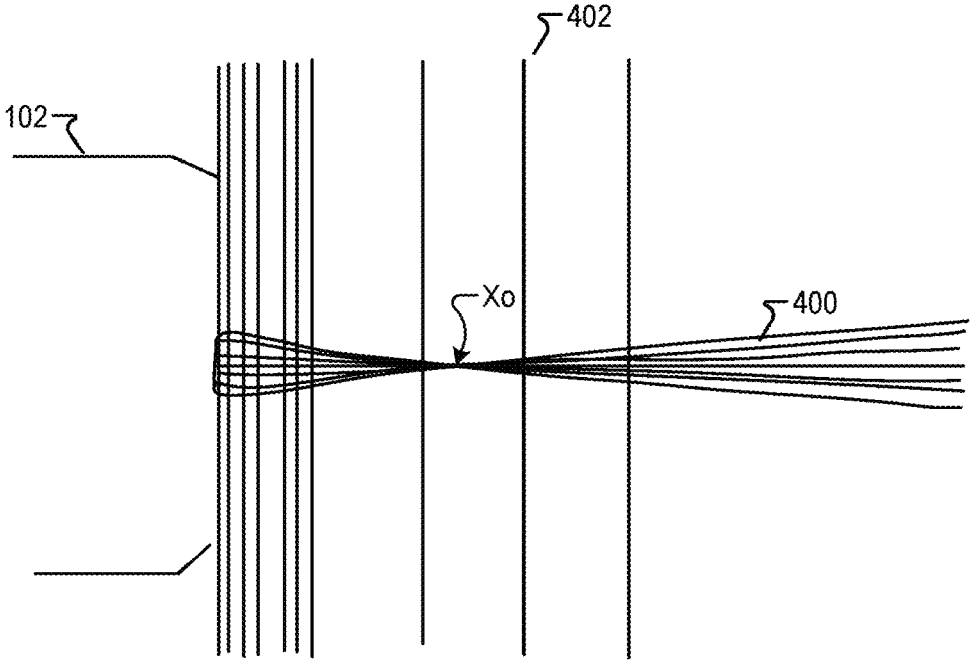
FIG. 4B is a magnified view of an acceleration space of the electron gun according to one example.

FIG. 4A is a schematic that shows an electron beam 400 and an electric field distribution 402 according to one example. Electrons are emitted from the cathode 102 when the cathode 102 is heated, a positive (i.e., with respect to the cathode 102) high voltage is applied to the anode 106 (e.g., several kilo-volts), and a negative (i.e., with respect to the cathode 102) is applied to the Wehnelt 104 (e.g., several hundred volts). Electrons emitted by the cathode 102 are drawn into a Wehnelt-anode acceleration space. The distributions of the electron beam 400 emitted from the cathode 102 and the electric field distribution 402 in the vicinity of the cathode 102 are shown in FIGS. 4A and 4B. A magnified view of the Wehnelt-anode acceleration space is shown in FIG. 4B. A cathode lens, known as an immersion objective, forms a crossover Xo as indicated in FIGS. 4A and 4B.

The location and size of the crossover Xo are a function of a cathode temperature, an emission current, and voltages applied to the anode 106 and the Wehnelt 104 (specifically the voltage applied to the Wehnelt 104).

The emitted electrons from the cathode 102 are accelerated by the acceleration voltage to become the electron beam 400 that advances toward the anode 106. Then, the electron beam 400 passes through an opening (i.e., bore) in the anode 106. Then, the electron beam 400 is emitted from the electron gun 100.

In e-beam instruments such as SEM, X-ray equipment, and Gaussian e-beam lithography systems, the crossover Xo is imaged onto a target using a lens system (e.g., electrostatic and/or magnetic lenses). The instrument resolution is defined by the lens system.

Figure 5:
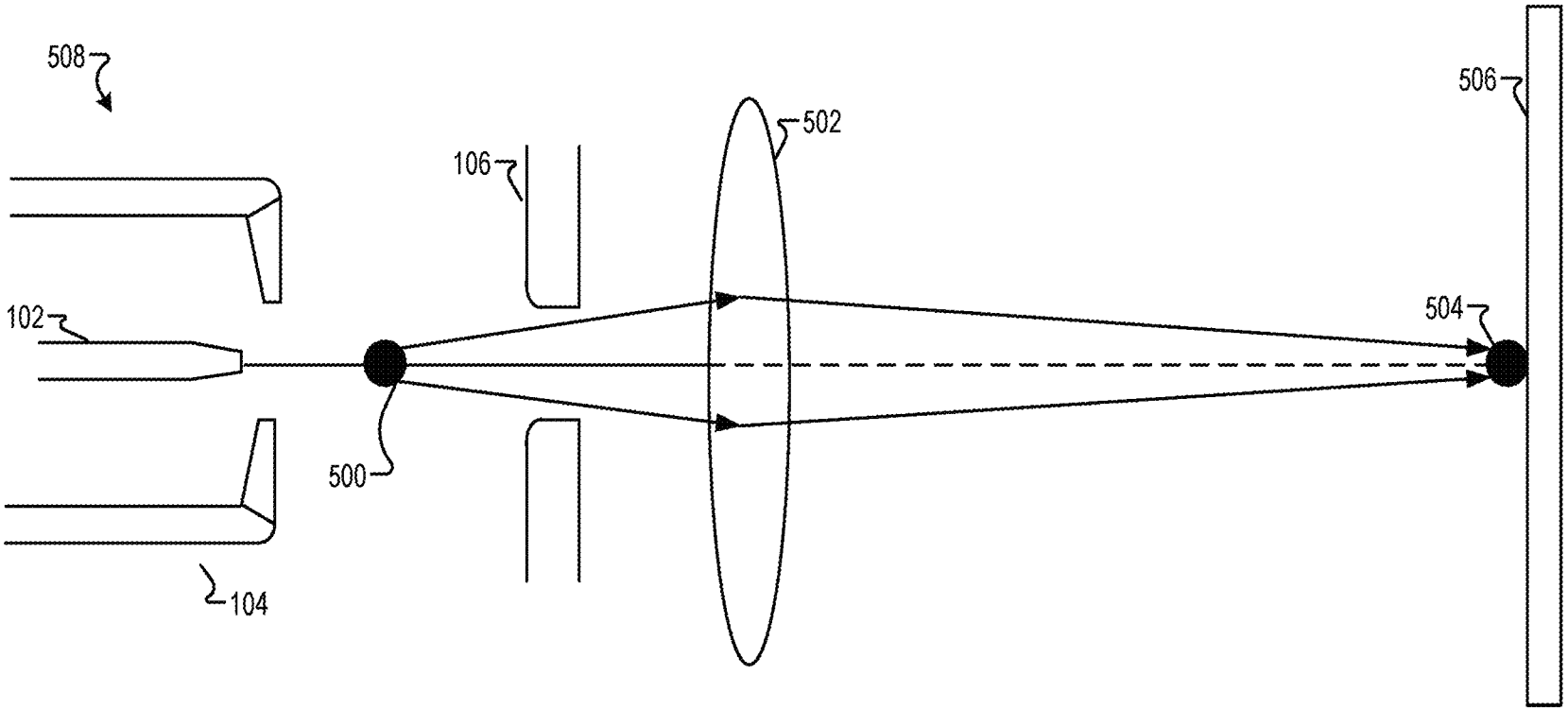
FIG. 5 is a schematic that shows an e-beam system according to one example.

FIG. 5 is a schematic that shows an e-beam system 508 according to one example. The crossover 500 is imaged onto the target 506 using a lens system 502. The image of the crossover 500 is the crossover image 504.

Figure 6:
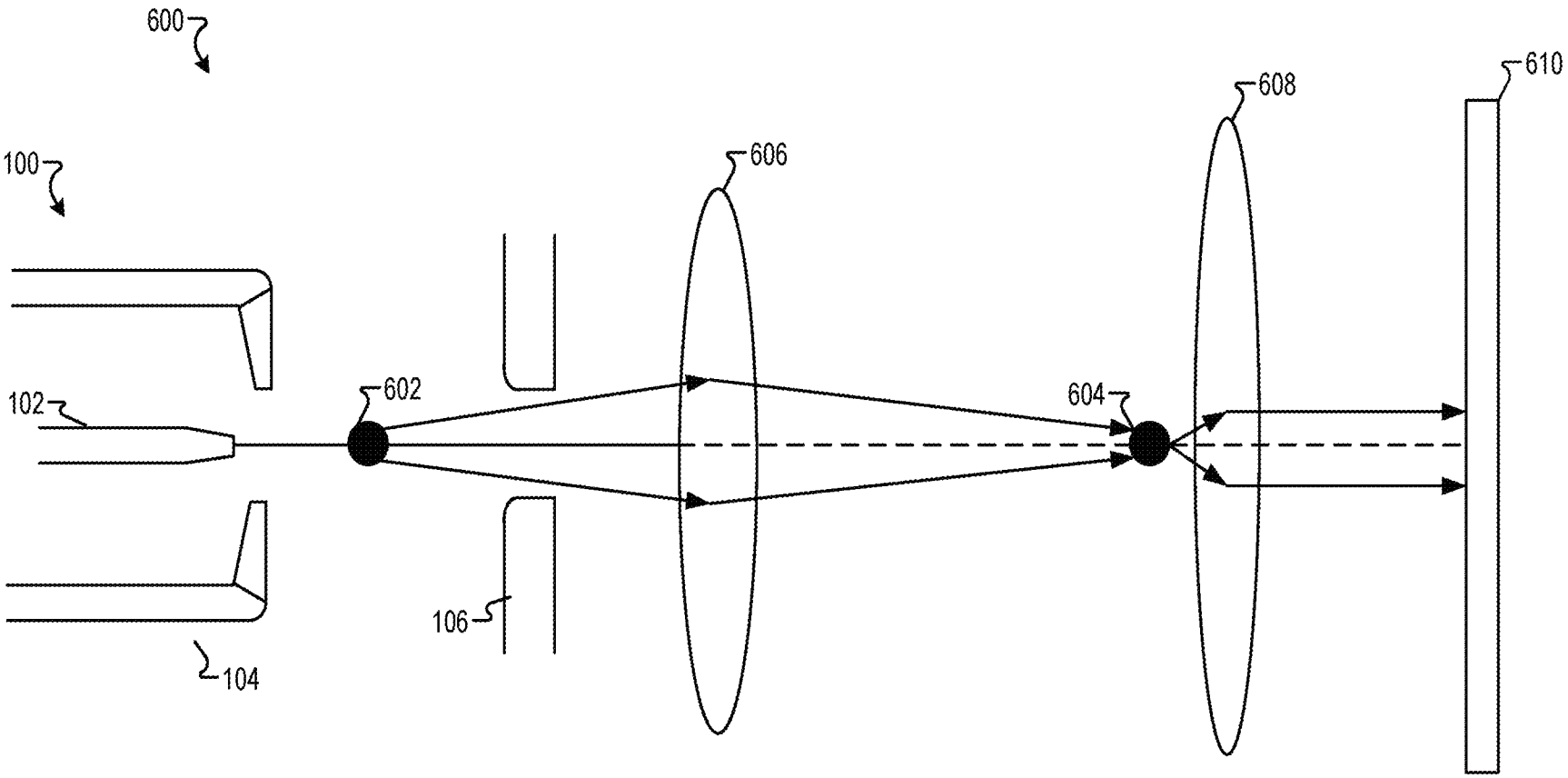
FIG. 6 is a schematic that shows a variable shape beam (VSB) lithography system according to one example.

FIG. 6 is a schematic that shows a variable shape beam (VSB) lithography system 600 according to one example. In the VSB lithography system 600, a crossover image 604 of the crossover 602 is formed at a back focal plane of an objective lens 608 (e.g., a lens system) using a lens system 606 (e.g., electrostatic and/or magnetic lenses). The size of the crossover Xo in a VSB system defines a convergence angle. The convergence angle defines a beam blur at a target 610.

As $LaB_6$ crystal losses accumulate with time, the size of the crystal decreases and the emitting surface sinks into surrounding materials as described previously herein. This dimensional change causes a cathode electric field change that leads to a thermionic emission current fall-off.

The thermionic emission current may be stabilized by electronic circuitry. The Wehnelt voltage, also called Bias voltage, is reduced to maintain a desired emission level. A lower Wehnelt voltage weakens the immersion objective, which results in an increase in the size of crossover Xo. Further, the crossover Xo shifts closer to the anode 106. The crossover shift is also referred to as the crossover axial displacement.

Figure 7:
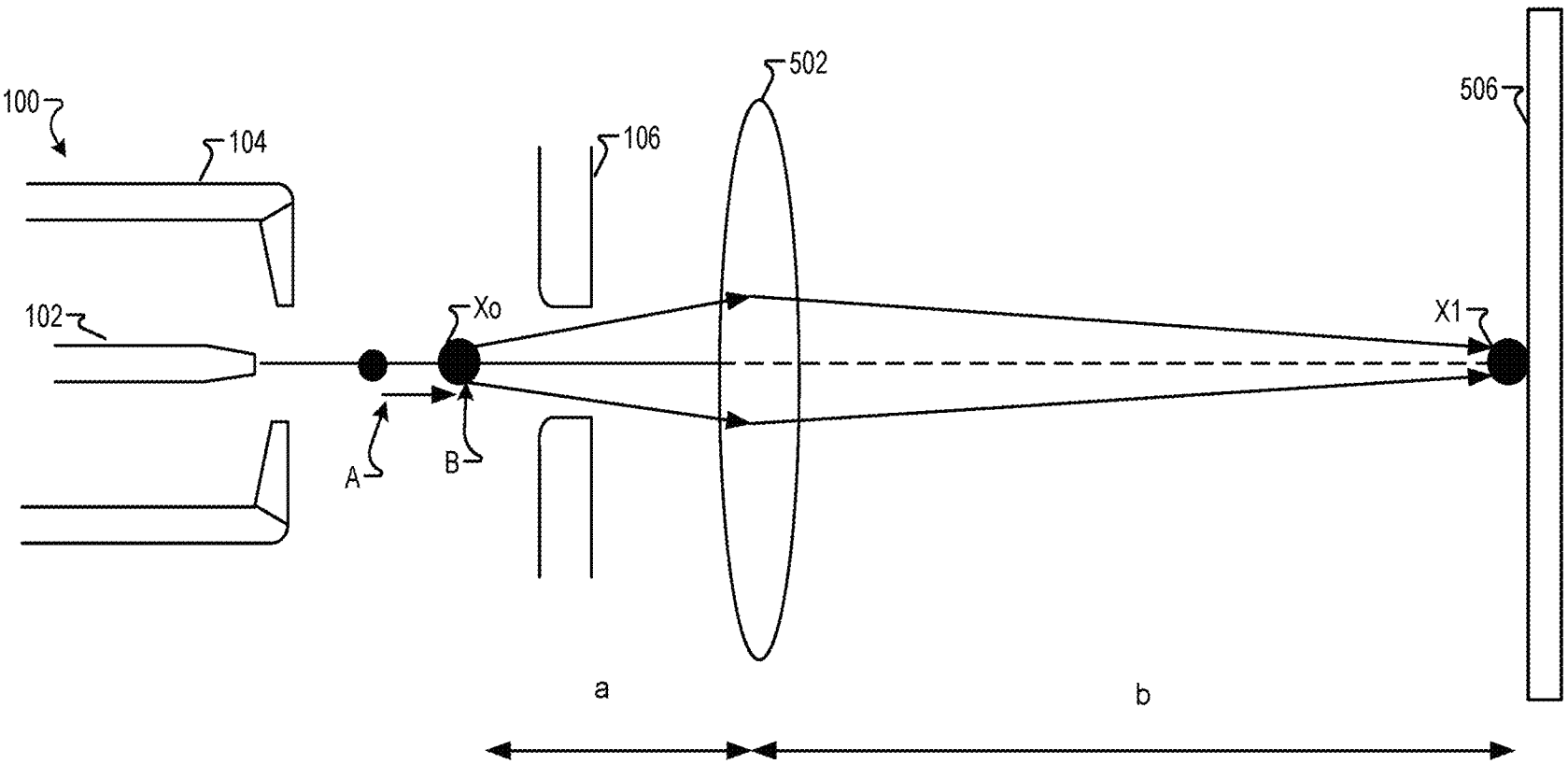
FIG. 7 is a schematic that shows an axial displacement of a crossover of the electron gun according to one example.

FIG. 7 is a schematic that shows the change in the size and location of the crossover Xo in the e-beam system 508 according to one example. The crossover Xo shifts towards the anode 106 (from position A to position B in FIG. 7). In addition, the diameter of the crossover Xo increases.

The lens (or lenses) optical magnification may be defined as:

$$M=b/a \quad (1)$$

where "b" is a distance between the lens system 502 and the target 506 and "a" is a distance between the crossover Xo position and the lens system 502. The lens optical magnification M increases when the crossover Xo position shifts towards the anode 106 (i.e., distance "a" decreases). The increase in the lens optical magnification causes a sharp increase in the size of the image of the crossover (e.g., size of image X1 in FIG. 7). A larger X1 means a loss of resolution in e-beam instruments. Similarly, a larger X1 leads to a greater beam blur in VSB tools. Once the lens optical magnification exceeds a threshold value, the cathode 102 has to be replaced.

The electron gun and associated methodology described herein has a stable crossover. The crossover Xo size is less affected by crystal loss. Further, the crossover axial displacement is reduced. Therefore, the cathode operational life is extended. Further, the resolution is improved in Gaussian tools/e-beam tools and the beam blur is reduced in VSB tools.

The Wehnelt bore D and the Wehnelt-cathode offset S of the electron gun 100 satisfy predetermined criteria. First, the Wehnelt bore D is selected from a first predetermined range. For example, the Wehnelt bore D may be selected in a range from about 1.4 mm to 2.5 mm. Second, the Wehnelt-cathode offset S is selected from a second predetermined range. For example, the second predetermined range may be from about 0.4 mm to about 0.8 mm. Further, the Wehnelt bore D and the Wehnelt-cathode offset S satisfy a predetermined dimensional relationship.

The Wehnelt bore D and the Wehnelt-cathode offset S are a function of the Wehnelt-anode distance $G_a$ and the anode bore diameter $d_a$.

In one embodiment, the predetermined dimensional relationship is given by:

$$(D-A\times\Delta)^2/S^{\acute{\alpha}}>B\times(G_a+d_a/\sigma) \quad (2)$$

where $\acute{\alpha}$=1.05 . . . 1.115, σ=11.5 . . . 12.5, Δ=0.15 to 0.30 mm, A is a first predetermined coefficient, and B is a second predetermined coefficient.

In one embodiment, the first predetermined coefficient is in a range from about 0.6 to about 1.2, in the range from about 0.7 to about 1.1, or in the range from about 0.8 to about 1, e.g., about 0.7, 0.75, 0.8, 0.85, 0.9, 0.95, 1, 1.05, or 1.

In one embodiment, the second predetermined coefficient is in the range from about 0.028 to about 0.068, or in the range from about 0.038 to about 0.058, e.g., 0.038, 0.040, 0.042, 0.044, 0.046, 0.048, 0.050, 0.052, 0.054, 0.056, or 0.058.

In one embodiment, the first predetermined coefficient is within 10% from 0.9 and the second predetermined coefficient is within 10% from 0.048.

In one embodiment, the first predetermined coefficient is 0.9 and the second predetermined coefficient is 0.048.

The disclosure also provides methods for making the electron guns described herein.

The method includes providing a cathode configured to provide an electron beam, providing a Wehnelt having a bore configured to pass the electron beam, identifying an offset between the Wehnelt and the cathode (e.g., applying equation (2)), depositing the Wehnelt proximate to the cathode at the identified offset, and depositing an anode proximate to the cathode. A diameter of the bore of the Wehnelt and an offset between the Wehnelt and the cathode satisfy a predetermined dimensional relationship. The predetermined dimensional relationship is at least a function of a diameter of the bore of the anode and the distance between the Wehnelt and the anode.

The method for selecting the Wehnelt bore D and the Wehnelt-cathode described herein greatly restricts the crossover Xo's size increase and the axial displacement by creating a stronger immersion objective. A stronger immersion objective is less sensitive to the crystal loss (e.g., $LaB_6$ loss) and the related geometrical changes such as diminishing crystal emitting surface sinking into a surrounding material.

EXAMPLES

To illustrate the capabilities of the electron gun described herein, exemplary results are presented.

Three electron guns were fabricated. A first electron gun has a conventional design (referred to herein as Design 1). Two electron guns were designed using the methodologies described herein. In other words, the Wehnelt-anode distance $G_a$ and the anode bore diameter $d_a$ satisfy the criteria described herein. The electron guns were compared with respect to the crossover diameter and the axial displacement.

Table 1 shows the electron gun crossover (Xo), diameter D, and axial location shift during service life for the three electron guns. A cathode having a diameter of 55 μm is used in all three exemplary electron guns. A cathode is considered worn out when the diameter reaches 45 μm and the cathode sunk by 10 μm.

Table 1 shows that the experimental results are in good agreement with the mathematical models described herein. For the electron gun having the first design (conventional design) the crossover size increased from 25.6 μm to 29.3 μm. The location of the crossover Xo has changed from 27.9 mm (new cathode) to 48.6 mm (worn out cathode). As described previously herein, the change in the crossover's size and location cause an increase in the diameter of the crossover image in the system. Such increase renders the cathode unusable. In the electron guns described herein (design 2 and design 3), the crossover's size increases is much less compared to a conventional design. Further, the axial displacement is reduced. The electron guns described herein have an axial displacement of less than 5.6 mm. In contrast, the electron gun having a conventional design has an axial displacement of 20 mm.

TABLE 1

| Model | Bore Diameter/ Offset (μm) | Xo Diameter, (μm) | Xo location from Wehnelt (mm) | Xo axial location shift during life (mm) | Brightness ($Acm^{-2}sr^{-1}$) |
|---|---|---|---|---|---|
| Design 1 (New) | 2.30/870 | 25.6 | 27.9 | | $2\times10^6$ |
| Design 1 (Worn out) | 2.30/870 | 29.3 | 48.6 | ~20 mm toward CL1 | $2\times10^6$ |
| Design 2 (New) | 2.30/700 | 24.0 | 23.1 | | $2\times10^6$ |
| Design 2 (Worn out) | 2.30/700 | 27.9 | 28.7 | ~5.6 mm toward CL1 | $2\times10^6$ |
| Design 3 (New) | 1.5/400 | 17.9 | 2.55 | | $2\times10^6$ |
| Design 3 (Worn out) | 1.5/400 | 23.2 | 2.95 | 0.4 mm toward CL1 | $2\times10^6$ |

The features of the present disclosure provide a multitude of improvements in the field of electron guns. In particular, the electron guns described herein extend a cathode operational life, while improving e-beam instrument's resolution and reducing VSB tools beam blur.

Obviously, numerous modifications and variations are possible in light of the above teachings. It is therefore to be understood that within the scope of the appended claims, the invention may be practiced otherwise than as specifically described herein.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, defines, in part, the scope of the foregoing claim terminology such that no inventive subject matter is dedicated to the public.

The invention claimed is:

1. An electron gun, comprising:

a cathode configured to provide an electron beam;

a Wehnelt having a bore, the bore being configured to pass the electron beam, the Wehnelt being offset from the cathode; and an anode having a bore disposed proximate to the Wehnelt, wherein a diameter of the bore of the Wehnelt and an offset between the Wehnelt and the cathode satisfy a predetermined dimensional relationship, the predetermined dimensional relationship being at least a function of a diameter of the bore of the anode and a distance between the Wehnelt and the anode, a first function of the diameter of the bore of the Wehnelt divided by the offset being greater than a second function of a sum of the diameter of the bore of the anode and the distance between the Wehnelt and the anode, and wherein the offset is between a front face of the cathode and a front face of the Wehnelt, the Wehnelt facing a back face of the anode.

2. The electron gun of claim 1, wherein the diameter of the bore of the Wehnelt is in a range from 1.4 mm to 2.5 mm.

3. The electron gun of claim 1, wherein the offset between the Wehnelt and the cathode is in a range from 0.4 mm to 0.8 mm.

4. The electron gun of claim 1, wherein a thickness of an aperture of the Wehnelt is in a range of 0.15 mm to 0.30 mm.

5. The electron gun of claim 1, wherein the predetermined dimensional relationship is:

$$(D-A\times\Delta)^2/S^{\acute{\alpha}}>B\times(G_a+d_a/\sigma)$$

where D is the diameter of the bore of the Wehnelt, S is the offset between the Wehnelt and the cathode, A is a first predetermined coefficient in a range from 0.6 to 1.2, Δ is a thickness of an aperture of the Wehnelt, B is a second predetermined coefficient in a range from 0.028 to 0.068, $G_a$ is the distance between the Wehnelt and the anode; $d_a$ is the diameter of the bore of the anode, σ is a third coefficient in a range from 11.5 to 12.5, and $\acute{\alpha}$ is a fourth coefficient in a range from 1.05 to 1.115.

6. The electron gun of claim 5, wherein the first predetermined coefficient is 0.9 and the second predetermined coefficient is 0.048.

7. The electron gun of claim 1, wherein the cathode includes a lanthanum hexaboride (LaB6) crystal emitter.

8. The electron gun of claim 7, wherein the lanthanum hexaboride (LaB6) crystal emitter has a crystallographic orientation of (100).

9. The electron gun of claim 7, wherein the cathode further comprises a non-emissive coating on an outer surface of sides of the lanthanum hexaboride (LaB6) crystal emitter.

10. An electron emission apparatus, comprising:

an electron gun including a cathode configured to provide an electron beam, a Wehnelt having a bore configured to pass the electron beam, the Wehnelt being offset from the cathode, and an anode having a bore disposed proximate to the Wehnelt, wherein a diameter of the bore of the Wehnelt and an offset between the Wehnelt and the cathode satisfy a predetermined dimensional relationship, the predetermined dimensional relationship being at least a function of a diameter of the bore of the anode and a distance between the Wehnelt and the anode, a first function of the diameter of the bore of the Wehnelt divided by the offset being greater than a second function of a sum of the diameter of the bore of the anode and the distance between the Wehnelt and the anode, and wherein the offset is between a front face of the cathode and a front face of the Wehnelt, the Wehnelt facing a back face of the anode.

11. The electron emission apparatus of claim 10, wherein the diameter of the bore of the Wehnelt is in a range from 1.4 mm to 2.5 mm.

12. The electron emission apparatus of claim 10, wherein the offset between the Wehnelt and the cathode is in a range from 0.4 mm to 0.8 mm.

13. The electron emission apparatus of claim 10, wherein a thickness of an aperture of the Wehnelt is in a range of 0.15 mm to 0.30 mm.

14. The electron emission apparatus of claim 10, wherein the predetermined dimensional relationship is:

$$(D-A\times\Delta)^2/S^{\acute{\alpha}}>B\times(G_a+d_a/\sigma)$$

where D is the diameter of the bore of the Wehnelt, S is the offset between the Wehnelt and the cathode, A is a first predetermined coefficient in a range from 0.6 to 1.2, Δ is a thickness of an aperture of the Wehnelt, B is a second predetermined coefficient in a range from 0.028 to 0.068, $G_a$ is the distance between the Wehnelt and the anode; $d_a$ is the diameter of the bore of the anode, σ is a third coefficient in a range from 11.5 to 12.5, and $\acute{\alpha}$ is a fourth coefficient in a range from 1.05 to 1.115.

15. The electron emission apparatus of claim 14, wherein the first predetermined coefficient is 0.9 and the second predetermined coefficient is 0.048.

* * * * *